US007285008B2

(12) United States Patent
Tsai

(10) Patent No.: US 7,285,008 B2
(45) Date of Patent: Oct. 23, 2007

(54) UPRIGHT BATTERY SEAT

(76) Inventor: Chou Hsuan Tsai, 15F, No. 4 Lane 127, Sec. 1, Fu-Hsing Rd., Hsin-Chuang City, Taipei Hsien (TW)

( * ) Notice: Subject to any disclaimer, the term of this patent is extended or adjusted under 35 U.S.C. 154(b) by 0 days.

(21) Appl. No.: 11/487,520

(22) Filed: Jul. 14, 2006

(65) Prior Publication Data

US 2007/0015399 A1 Jan. 18, 2007

(30) Foreign Application Priority Data

Jul. 14, 2005 (TW) ..... 94211981 U

(51) Int. Cl.
*H01R 3/00* (2006.01)

(52) U.S. Cl. ..... 439/500

(58) Field of Classification Search ..... 439/500, 439/856; 361/801, 807; 429/100, 96–99
See application file for complete search history.

(56) References Cited

U.S. PATENT DOCUMENTS 5,922,489 A * 7/1999 Adachi ..... 429/100
5,980,309 A * 11/1999 Frantz et al. ..... 439/500
6,527,584 B2 * 3/2003 Ninomiya ..... 439/500
6,603,670 B1 * 8/2003 Chien ..... 361/801
6,844,107 B2 * 1/2005 Ohashi et al. ..... 429/97
7,059,894 B1 * 6/2006 Huang ..... 439/500
2006/0263677 A1 * 11/2006 Tsai ..... 429/97

FOREIGN PATENT DOCUMENTS

TW 318609 A1 10/1997
TW 318610 A1 10/1997
TW 391568 A1 5/2000
TW 435833 A1 5/2001

* cited by examiner

*Primary Examiner*—Alexander Gilman

(57) ABSTRACT

An upright battery seat for a button battery includes a base and positive and negative terminals each having an elastic arm located in a slot and electrically connected to the battery, a positioning portion positioned with the base, and a pin portion extending out of the base. The base has a circumferential wall and a longitudinal placement surface to form the slot. The wall is formed with an opening and first and second engagement portions. The first and second engagement portions engage with two side edges of the battery. The first engagement portion has an engaging surface substantially perpendicular to an inner surface of the wall. The arm of the positive terminal projects over the inner surface and enables one side of the battery to engage with the engaging surface. When the battery is pressed down, the side edge of the battery can escape from the engaging surface without locking.

9 Claims, 5 Drawing Sheets

UPRIGHT BATTERY SEAT

BACKGROUND OF THE INVENTION

1. Field of the Invention

The invention relates to an electrical connector, and more particularly to a battery seat to be connected to a button battery.

2. Description of the Related Art

A mainboard usually has a battery seat to be electrically connected to a battery for providing power to electrical elements mounted thereon. The conventional battery seats may be found in Taiwan Patent Publication Nos. TW318609, TW318610, TW391568 and TW435833.

Because the electrical product is gradually minimized, the battery seat connected to a button battery has to be disposed on the mainboard in an upright manner in order to save the area occupied by the battery seat on the mainboard.

TW435833 is the commonly assigned patent and discloses a battery seat that may be easily used. The battery seat has an upright pattern and the structure thereof is illustrated in FIGS. 4 to 7 of TW435833 patent. The battery seat has a base 1, a positive terminal 2 and a negative terminal 3. The base 1 has a circumferential wall 11 for defining a placement slot 12 such that the battery 95 placed therein cannot escape from the circumferential wall. The circumferential wall 11 has an opening 13 into which a finger may be inserted, and two first engagement portions 14 and one second engagement portion 15 for engaging with the battery 95 placed in the placement slot. The first engagement portions 14 are formed with inner and outer guiding slants 141 and 142 for guiding in/out the battery. In use, as shown in FIG. 5 of TW435833 patent, one end of the battery 95 is directly inserted into the placement slot 12 and is then engaged by the second engagement portion 15. Then, the battery 95 is laterally pressed. The other end of the battery is engaged by the first engagement portion 14, as shown in FIG. 6 of TW435833 patent. When the battery 95 is to be taken out, the finger is inserted into the opening 13 and pushes the battery outward. As shown in FIG. 10 of TW435833 patent, the contact 21 of the positive terminal is positioned on the inner surface of the circumferential wall. Such a design has the mistake-proof effect. That is, when the battery is incorrectly installed, the positive connection terminal of the battery contacts the positive terminal 2 and the negative terminal 3, and no power of the battery will be outputted because the front side and the circumference of the battery are the positive connection terminal, and the bottom surface of the battery is the negative connection terminal.

However, the prior art still has some drawbacks.

1. The first engagement portion 14 is formed with the inner and outer guiding slants 141 and 142 for guiding in/out the battery. Thus, when the engaging area is too large, the applied force for guiding in/out has to be larger, and the operation is inconvenient. When the engaging area is too small, the guiding in/out function can be easily achieved but the battery cannot be firmly positioned and tends to loosen.

2. As shown in FIG. 7 of TW435833 patent, the positive terminal 2 has two pins 23 spaced apart by a gap since the mainboard is formed with three holes corresponding to one upright battery seat to be inserted. Thus, one positive terminal has to be made by pressing a wider material plate, and the material waste is larger.

3. As shown in FIG. 10 of TW435833 patent having the mistake-proof design, the contact 21 of the positive terminal 2 is located on the inner surface of the circumferential wall, and the battery 95 contacts the positive terminal at one point of a lateral side, and the contact is not quite reliable.

SUMMARY OF THE INVENTION

It is therefore an object of the invention to provide an upright battery seat for stably and surely locking a battery, and the battery can be taken out without engagement in a laborsaving manner.

Another object of the invention is to provide an upright battery seat having two positive terminals to save the material and having two contact points to achieve the more reliable electrical connection.

To achieve the above-identified objects, the invention provides an upright battery seat to be connected to a button battery. The battery seat includes a base and at least one positive terminal and at least one negative terminal each having an elastic arm, a positioning portion and a pin portion. The base has a circumferential wall extending substantially vertically and a longitudinal placement surface to form a placement slot with one opened side to prevent the battery placed in the placement slot from escaping from the circumferential wall. A top of the circumferential wall is formed with an opening into which a finger may be inserted, at least one first engagement portion and at least one second engagement portion. The at least one first engagement portion is close to the opening and engages with one side edge of the battery. The at least one second engagement portion engages with the other side edge of the battery. The elastic arm is located in the placement slot and is electrically connected to the battery. The positioning portion is positioned with the base and the pin portion extends out of the base. The at least one first engagement portion of the base has an engaging surface substantially perpendicular to an inner surface of the circumferential wall. The elastic arm of the at least one positive terminal projects over the inner surface of the circumferential wall and elastically presses the battery upward to enable the battery to press against the circumferential wall near the opening and enable one side of the battery to engage with the engaging surface of the at least one first engagement portion. When the battery is pressed down, the side edge of the battery can escape from the engaging surface of the at least one first engagement portion without locking.

Other objects, features, and advantages of the invention will become apparent from the following detailed description of the preferred but non-limiting embodiments. The following description is made with reference to the accompanying drawings.

DETAILED DESCRIPTION OF THE INVENTION

Figure 1:
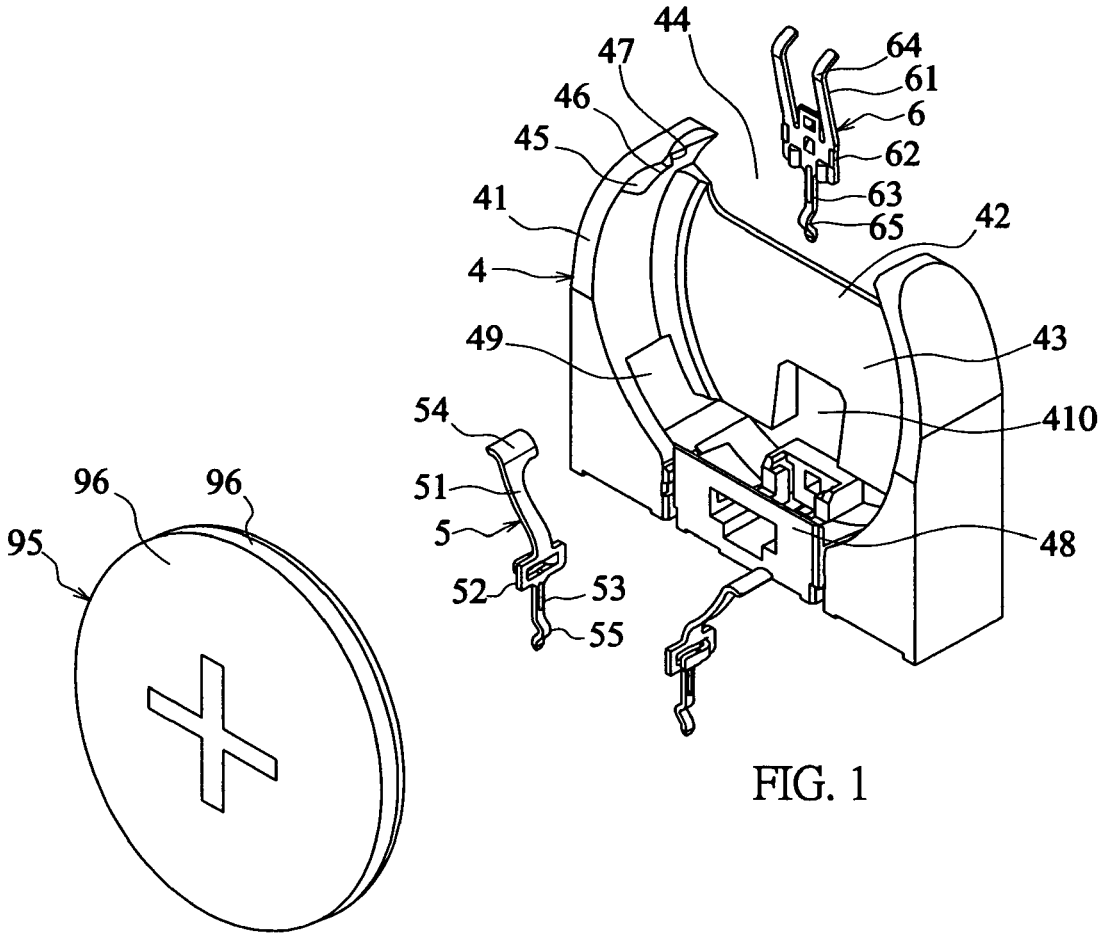
FIG. 1 is a pictorially exploded view showing a battery seat according to a first embodiment of the invention.
Figure 2:
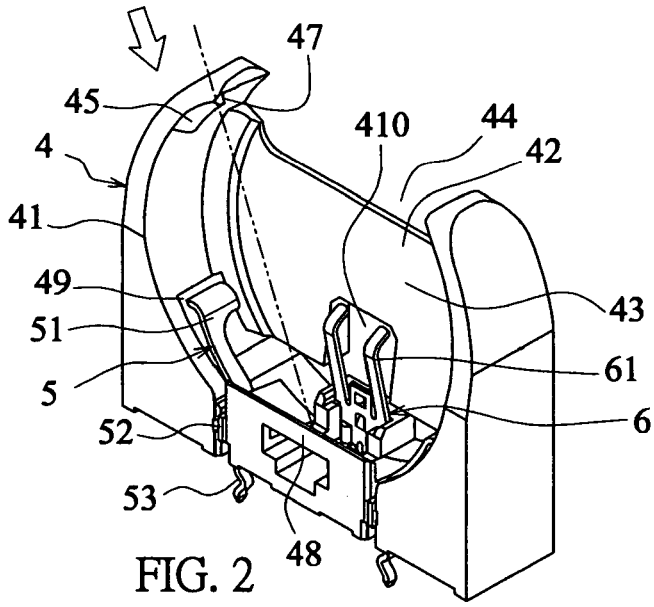
FIG. 2 is a pictorially assembled view showing the battery seat according to the first embodiment of the invention.

Referring to FIGS. 1 and 2, an upright battery seat to be connected to a button battery according to the invention includes a base 4, two positive terminals 5 and one negative terminal 6.

The upright base 4 has a circular and circumferential wall 41 extending substantially in a vertical direction and a longitudinal placement surface 42 to form a placement slot 43 with one opened side. Thus, a battery 95 placed in the placement slot 43 cannot escape from the circumferential wall 41. The placement surface 42 is a slant surface. The topmost end of the circumferential wall 41 is formed with an opening 44 into which a finger can be inserted. The opening 44 occupies about ¼ arcs, and the placement surface 42 is formed with a notch, which corresponds to the opening 44 and is slightly lower than the circumferential wall 41. Each of two sides of the circumferential wall 41 close to the opening 44 is formed with a first engagement portion 45 engaging with a top end of the battery placed in the placement slot 43. The first engagement portion 45 is formed with a guiding slant surface 46 and an engaging surface 47 perpendicular to the inner surface of the circumferential wall 41. One side of the circumferential wall 41 corresponding to the first engagement portion 45 is formed with a second engagement portion 48 for engaging with the battery placed in the placement slot 43. The inner surface of the circumferential wall 41 at each of two sides of the second engagement portion 48 is formed with a depression 49, and the placement surface 42 is also formed with a depression 410.

The positive terminal 5 has an elastic arm 51, a positioning portion 52 and a pin portion 53. The elastic arm 51 is disposed in the placement slot 43 and is formed with a projecting contact 54 close to its distal end. The positioning portion 52 is positioned with the base 4. The pin portion 53 longitudinally extends out of the bottom of the base 4 and has a bottom end formed with an elastic hook 55 for hooking the hole of a to be-connected circuit board. The elastic arms 51 of the two positive terminals 5 project over the inner surface of the circumferential wall 41 and extend in opposite directions toward the inner surface of the circumferential wall. The two elastic arms 51 of the positive terminals can elastically move in the depression 49.

The negative terminal 6 has an elastic arm 61, a positioning portion 62 and a pin portion 63.The elastic arm 61 is located in the placement slot 43 and is formed with a projecting contact 64 close to the distal end thereof. The positioning portion 62 is positioned with the base 4. The pin portion 63 longitudinally extends out of the bottom of the base 4 and is formed with an elastic hook 65 at a bottom thereof so as to hook another hole of the to-be-connected circuit board. The elastic arm 61 projects over the placement surface 42 and may elastically move in the depression 410.

Figure 4:
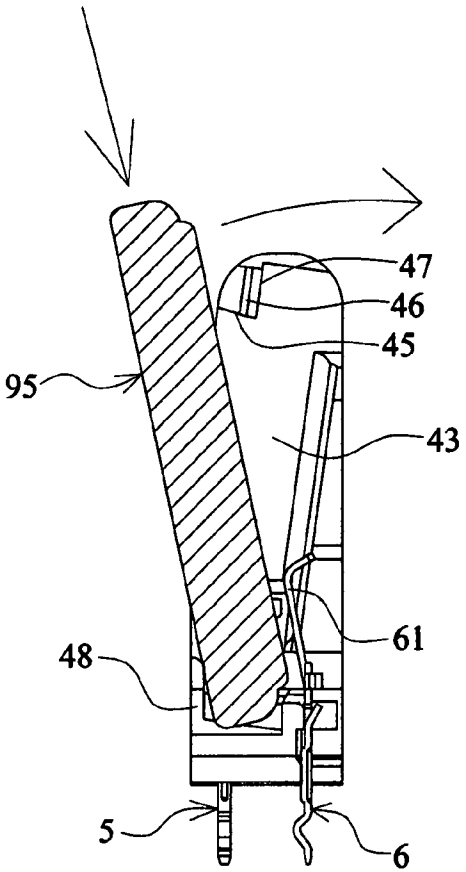
FIG. 4 is a side view showing a usage state of the battery seat according to the first embodiment of the invention.
Figure 3:
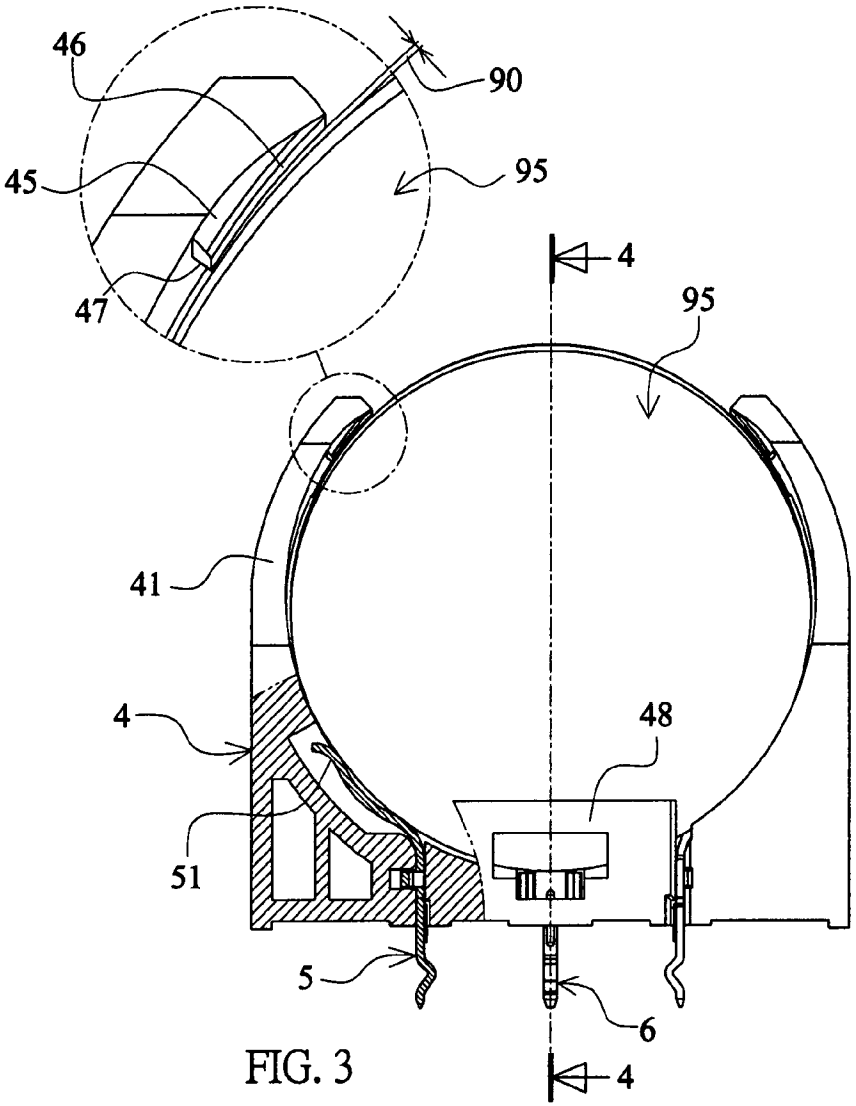
FIG. 3 is a front view showing a usage state of the battery seat according to the first embodiment of the invention.
Figure 6:
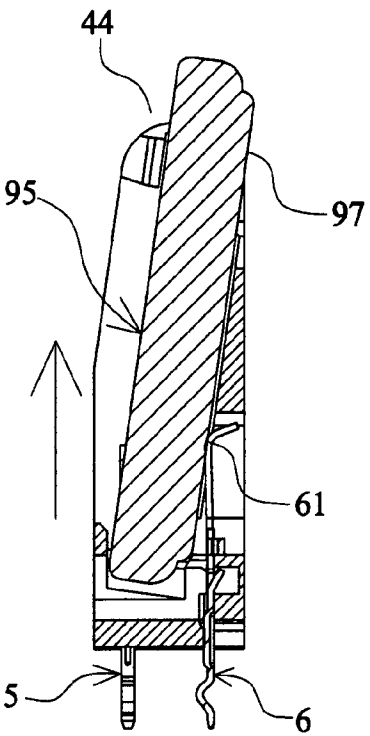
FIG. 6 is a side view showing a usage state of the battery seat according to the first embodiment of the invention.
Figure 5:
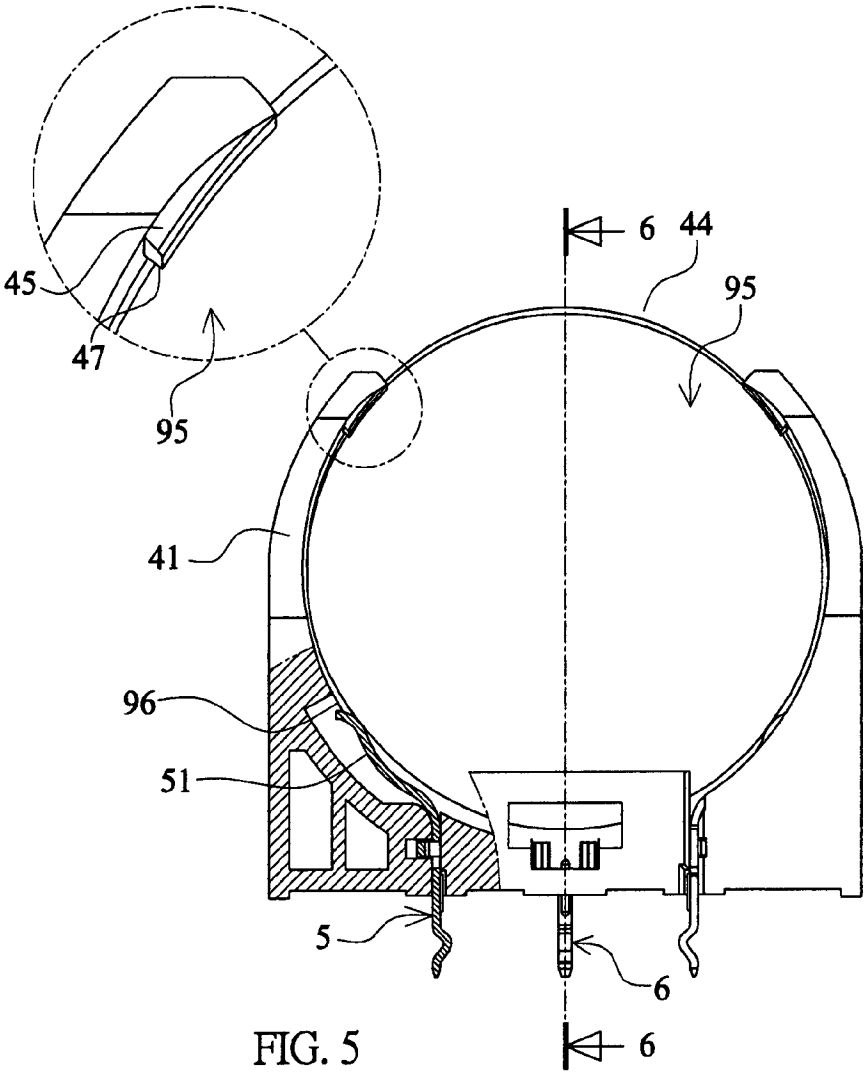
FIG. 5 is a front view showing a usage state of the battery seat according to the first embodiment of the invention.

According to the above-mentioned structure, as shown in FIGS. 3 and 4, when the battery is to be installed, one side of the battery 95 is inserted into the placement slot 43 and engages with the second engagement portion 48 and then the battery 95 is pressed down. At this time, the battery 95 is slightly lowered, and the other side of the battery 95 escapes from the range engaging with the engaging surface 47 of the first engagement portion 45 and a gap 90 is formed therebetween. At this time, the battery 95 can be slightly pressed into the placement slot 43. As shown in FIGS. 5 and 6, when the hand releases, the two elastic arms 51 of the positive terminals 5 elastically press the battery 95 upward such that the battery 95 rests against the circumferential wall in the direction to the opening 44. Thus, one side of the battery 95 is locked and positioned by the engaging surface 47 of the first engagement portion 45. At this time, a positive connection terminal 96 around the battery 95 contacts the symmetrical elastic arms 51 of the positive terminal 5, and a negative connection terminal 97 on the bottom surface of the battery contacts the elastic arm 61 of the negative terminal 6. In addition, when the battery 95 is being installed, one side of the battery may be inserted into the placement slot 43 to engage with the second engagement portion 48. Then, the battery 95 is pressed laterally such that the battery 95 enters the slot along the guiding slant surface 46 and engages with the engaging surface 47 of the first engagement portion 45.

Figure 7:
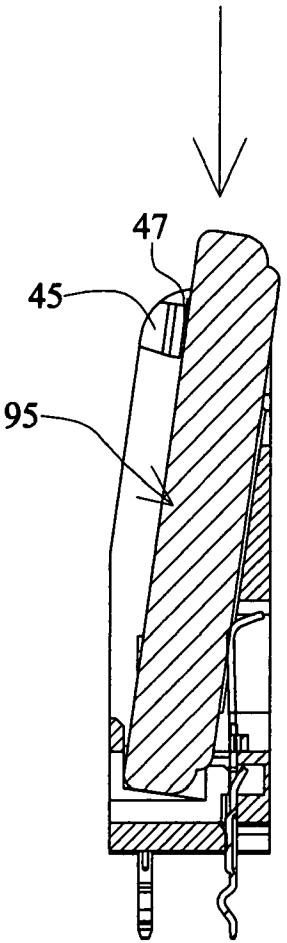
FIG. 7 is a side view showing a usage state of the battery seat according to the first embodiment of the invention.

As shown in FIG. 7, when the battery 95 is to be taken out, the battery 95 is pressed down and is slightly lowered such that the other side of the battery 95 escapes the engaging surface 47 of the first engagement portion 45. At this time, the battery 95 can be pushed out smoothly.

Figure 8:
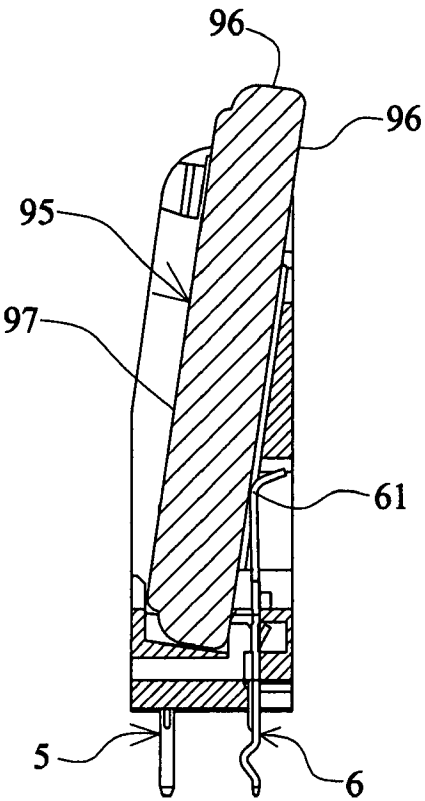
FIG. 8 is a side view showing a usage state of the battery seat according to the first embodiment of the invention.

As shown in FIG. 8, the invention may be configured to have the mistake-proof effect. When the battery 95 is incorrectly installed with the front side facing the placement slot 43, the positive connection terminal 96 on the front side of the battery contacts the elastic arm 61 of the negative terminal 6, and the positive connection terminal 96 on the circumferential surface of the battery contacts the elastic arm 51 of the positive terminal 5. Thus, the negative connection terminal 97 of the battery does not contact any terminal, and the battery cannot work such that the mistake-proof effect can be achieved. Otherwise, if the battery is wrongly installed into the battery seat without the mistake-proof effect, the negative connection terminal 97 of the battery contacts the positive terminal 5 and the positive connection terminal 96 of the battery contacts the negative terminal 6, and the mainboard may be interfered by poor signals.

Figure 9:
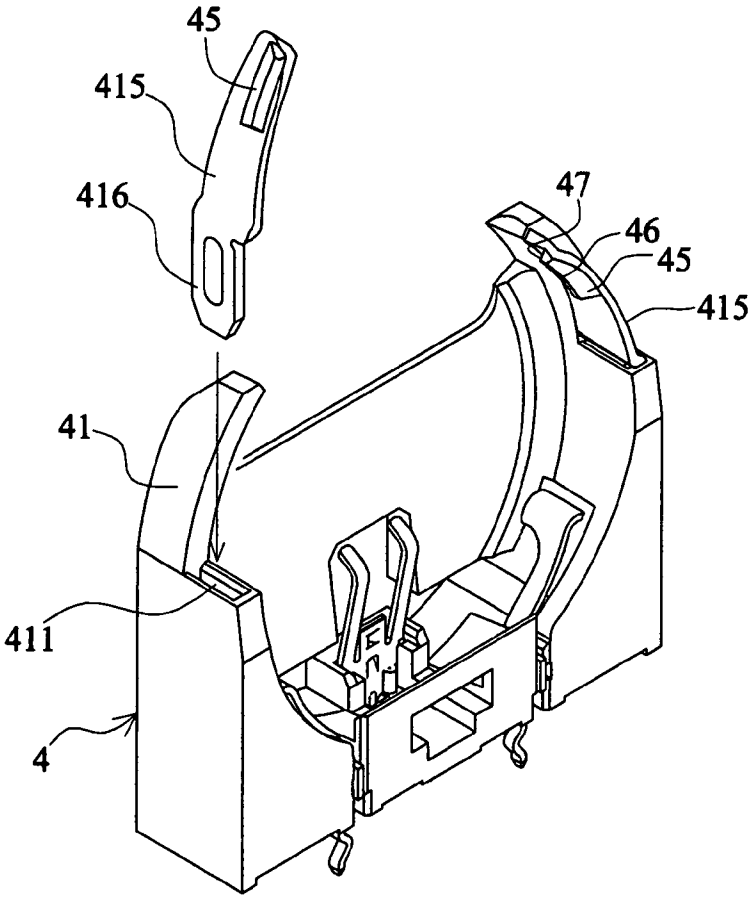
FIG. 9 is a pictorial view showing a battery seat according to a second embodiment of the invention.

As shown in FIG. 9, the second embodiment of the invention is almost the same as the first embodiment except that an engaging piece 415 made of a metal material is formed on each of two sides of the circumferential wall 41 of the base 4 of the second embodiment. The engaging piece 415 is integrally formed with a first engagement portion 45, which also has a guiding slant surface 46 for guiding in the battery and an engaging surface 47 perpendicular to the inner surface of the circumferential wall 41. In addition, two sides of the circumferential wall 41 are formed with slots 411, and the engaging piece 415 has an arced shape and a bottom formed with a fitting board 416 to fit with the slot 411.

Figure 10:
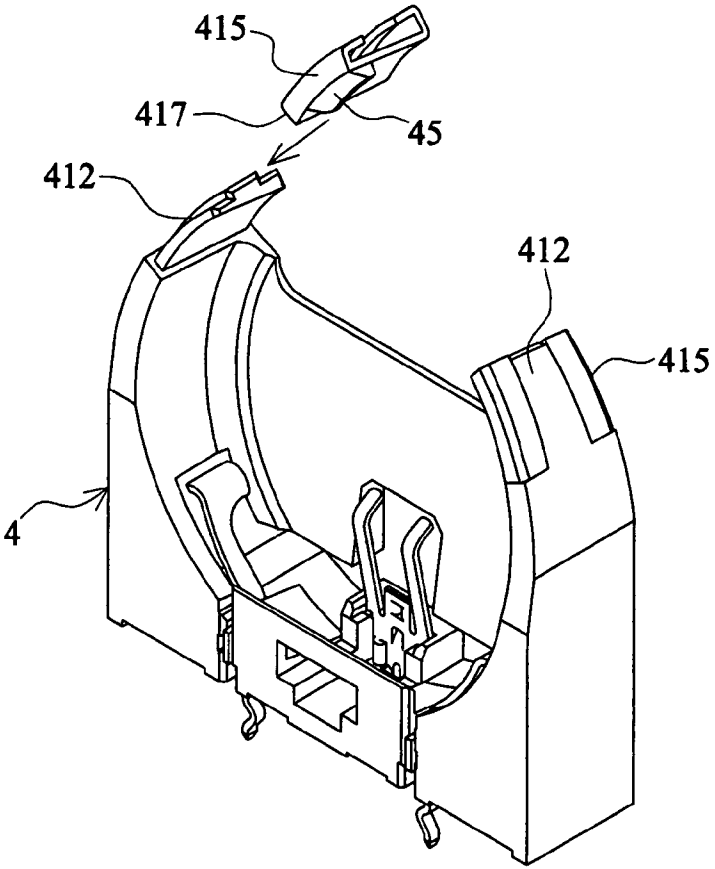
FIG. 10 is a pictorial view showing a battery seat according to a third embodiment of the invention.

As shown in FIG. 10, the third embodiment of the invention is almost the same as the second embodiment except that the engaging piece 415 of the third embodiment has fitting slots 417, and the two sides of the circumferential wall 41 of the base 4 are formed with fitting boards 412 to fit with the fitting slots 417 of the engaging piece 415, respectively.

According to the embodiments mentioned hereinabove, the invention has the following advantages.

First, the engaging surface 47 of the first engagement portion 45 is perpendicular to the inner surface of the circumferential wall 41, so the battery can be surely locked. However, when the battery is to be taken out, the battery can completely escape from the locking of the engaging surface 47, and the battery has to be pushed outward lightly. So, the invention can firmly lock the battery and enable the battery to be taken out in a laborsaving manner without locking.

Second, the invention has two positive terminals to save the material in the manufacturing process and to achieve the reliable electrical connection effect by two contact points.

Third, the invention has the mistake-proof effect to prevent the incorrectly installed battery from causing poor signals to interfere the mainboard.

While the invention has been described by way of examples and in terms of preferred embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An upright battery seat to be connected to a button battery, the battery seat comprising:

a base having a circumferential wall extending substantially vertically and a longitudinal placement surface to form a placement slot with one opened side to prevent the battery placed in the placement slot from escaping from the circumferential wall, wherein a top of the circumferential wall is formed with an opening into which a finger may be inserted, at least one first engagement portion and at least one second engagement portion, the at least one first engagement portion is close to the opening and engages with one side edge of the battery, and the at least one second engagement portion engages with the other side edge of the battery; and at least one positive terminal and at least one negative terminal each having an elastic arm, a positioning portion and a pin portion, wherein:

the elastic arm is located in the placement slot and is electrically connected to the battery;

the positioning portion is positioned with the base and the pin portion extends out of the base;

the at least one first engagement portion of the base has an engaging surface substantially perpendicular to an inner surface of the circumferential wall;

the elastic arm of the at least one positive terminal projects over the inner surface of the circumferential wall and elastically presses the battery upward to enable the battery to press against the circumferential wall near the opening and enable one side of the battery to engage with the engaging surface of the at least one first engagement portion; and when the battery is pressed down, the side edge of the battery can escape from the engaging surface of the at least one first engagement portion without locking.

2. The battery seat according to claim 1, wherein the at least one first engagement portion of the base is formed with a guiding slant surface, and the battery enters the placement slot along the guiding slant surface and engages with the engaging surface of the at least one first engagement portion when the battery is pressed into the placement slot.

3. The battery seat according to claim 1, wherein the placement surface of the base is formed with a depression, and the elastic arm of the at least one negative terminal may elastically move in the depression.

4. The battery seat according to claim 1, wherein the placement surface of the base is a slant surface.

5. The battery seat according to claim 1, wherein the pin portion of the at least one positive terminal is formed with an elastic hook for hooking a hole of a to-be-connected circuit board, and the pin portion of the at least one negative terminal is formed with an elastic hook for hooking another hole of the to-be-connected circuit board.

6. The battery seat according to claim 1, wherein the battery seat comprises two positive terminals having two elastic arms extending in opposite directions toward the inner surface of the circumferential wall.

7. The battery seat according to claim 6, wherein the inner surface of the circumferential wall of the base is formed with two depressions, and the elastic arms of the two positive terminals can elastically move in the depressions.

8. The battery seat according to claim 1, wherein at least one engaging piece integrally formed with the at least one first engagement portion is fixed to the circumferential wall.

9. The battery seat according to claim 8, wherein the at least one engaging piece is made of a metal material.

* * * * *